US007922619B2

(12) United States Patent
Ono

(10) Patent No.: US 7,922,619 B2
(45) Date of Patent: Apr. 12, 2011

(54) CONVEYOR STRUCTURE, TREAD MILL, AND CONVEYOR

(76) Inventor: Motoji Ono, Saitama (JP)

( * ) Notice: Subject to any disclaimer, the term of this patent is extended or adjusted under 35 U.S.C. 154(b) by 0 days.

(21) Appl. No.: 12/770,112

(22) Filed: Apr. 29, 2010

(65) Prior Publication Data

US 2010/0279819 A1 Nov. 4, 2010

(30) Foreign Application Priority Data

Apr. 30, 2009 (JP) ..... 2009-111099

(51) Int. Cl.
*A63B 71/00* (2006.01)

(52) U.S. Cl. ..... 482/2; 482/8; 482/51; 482/54; 482/901

(58) Field of Classification Search ..... 482/1–9, 482/51, 54, 900–902; 119/700
See application file for complete search history.

(56) References Cited

U.S. PATENT DOCUMENTS

| | | | | |
|---|---|---|---|---|
| 5,081,991 | A * | 1/1992 | Chance | 600/411 |
| 5,556,352 | A * | 9/1996 | Chang | 482/52 |
| 6,302,826 | B1 * | 10/2001 | Lee | 482/54 |
| 6,409,633 | B1 * | 6/2002 | Abelbeck | 482/54 |
| 2006/0276306 | A1 * | 12/2006 | Pan et al. | 482/54 |

FOREIGN PATENT DOCUMENTS

JP 2005-000326 1/2005

* cited by examiner

*Primary Examiner* — Glenn Richman
(74) *Attorney, Agent, or Firm* — Squire, Sanders & Dempsey (US) LLP

(57) ABSTRACT

The present invention provides a power-saving tread mill. A power-saving tread mill includes: a pair of rollers 10, 20; and an endless belt 30 wound around the pair of rollers 10, 20, wherein at least one of the rollers 10, 20 has: an armature 24*a* having iron cores 24*c* and coils 24*c* wound around the iron cores 24*c*; and permanent magnets 23 rotatable with the one of the rollers 10, 20 integrally, and electromagnetic induction produced between the permanent magnets 23 and the armature 24*a* produces induced electric current flowing through the coils 24*c* when the one of the rollers 10, 20 is rotated.

3 Claims, 4 Drawing Sheets

CONVEYOR STRUCTURE, TREAD MILL, AND CONVEYOR

CROSS-REFERENCE TO RELATED APPLICATION

This application claims the foreign priority benefit under Title 35, United States Code, §119 (a)-(d), of Japanese Patent Application No. 2009-111099, filed on Apr. 30, 2009, in the Japan Patent Office, the disclosure of which is herein incorporated by reference in its entirety.

BACKGROUND OF THE INVENTION

1. Field of the Invention

The present invention relates to a conveyor structure, a tread mill, and a conveyor.

2. Description of the Related Art

Conventionally, as an example of an exercise machine, a tread mill is known which allows a user to run on an endless belt wound around a pair of rollers. (See, for example, Japanese Patent Laid-open Publication No. 2005-000326)

A tread mill or a conveyor of a conventional type has rollers driven by a motor and allows a user to walk or goods to be conveyed on an endless belt. A more energy-saving conveyor structure is increasingly needed for use in the tread mill or the conveyor etc.

SUMMARY OF THE INVENTION

The present invention is conceived in view of the aforementioned necessity, and an object thereof is to provide a conveyor structure, a tread mill, and a conveyor having a more energy saving ability.

In order to achieve the aforementioned object, the present invention provides a conveyor structure which comprises: at least two rollers; and an endless belt wound around the rollers, wherein at least one of the rollers has: an armature having iron cores and coils wound around the iron cores; and permanent magnets rotatable with the one of the rollers integrally, and wherein electromagnetic induction produced between the permanent magnets and the armature produces an electric current flowing through the coils when the one of the rollers is rotated.

In another aspect, the present invention provides a tread mill having the conveyor structure, wherein a person can run on the endless belt.

In another aspect, the present invention provides a conveyor having the conveyor structure, wherein the conveyor can convey an article placed on the endless belt.

The present invention has a power-saving ability since the electric current produced when the roller is rotated can be reused. In addition, the present invention has a space-saving ability since the armature and the permanent magnets constituting the compact power-generating mechanism are disposed in the roller.

BEST MODE FOR CARRYING OUT THE INVENTION

Embodiments of the present invention will be explained as follows with reference to accompanying drawings showing examples of the conveyor structure of the present invention applied to a tread mill and a conveyor. It should be noted that, in the following explanation, same components are denoted by same reference symbols, and the overlapped description therefor will be omitted. In addition, directions, e.g. upward, downward, forward, backward, leftward, and rightward, will be explained with reference to the orientation of a user running on the tread mill (See FIG. 1).

First Embodiment

Figure 1:
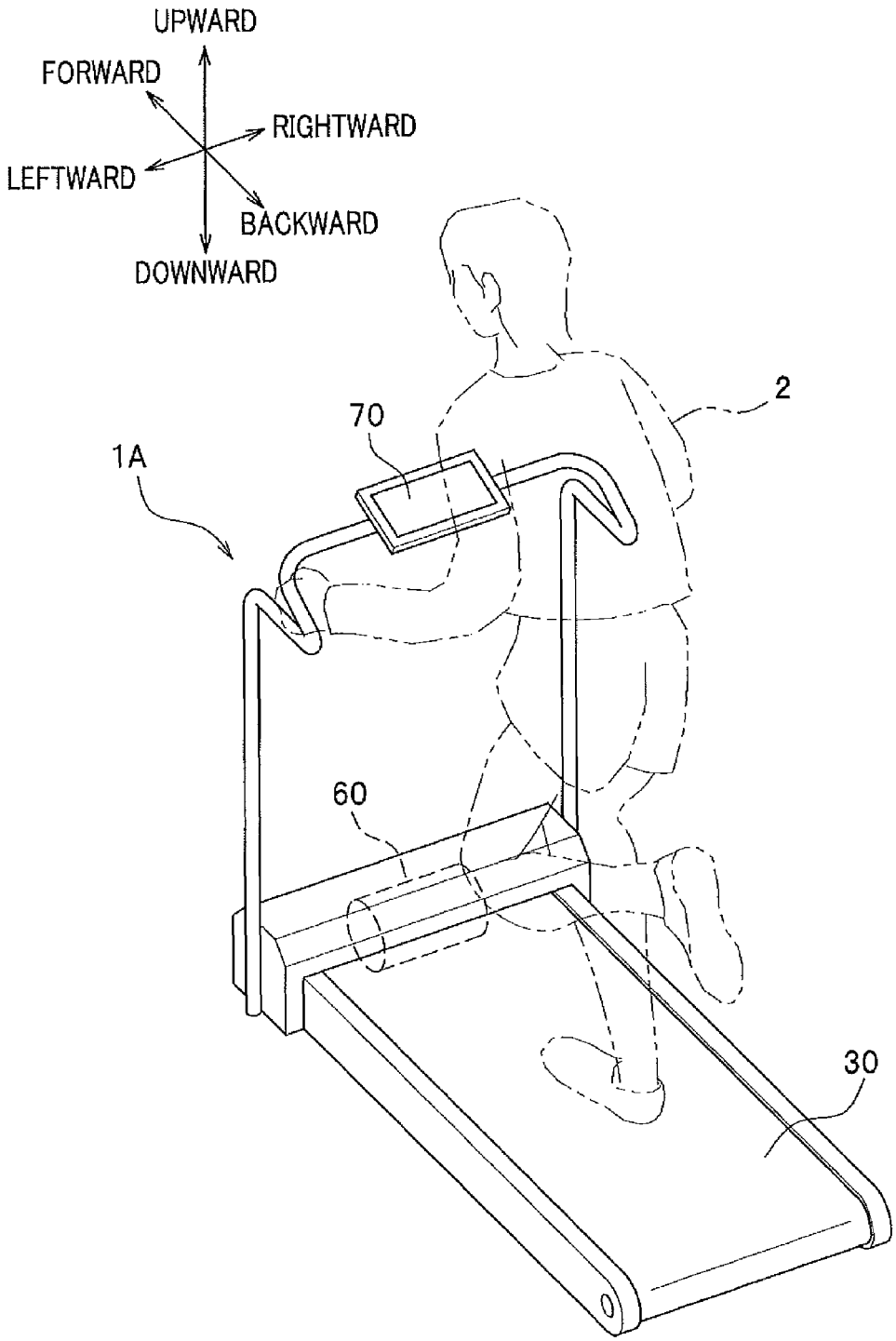
FIG. 1 is a general perspective view showing a tread mill according to a first embodiment of the present invention.
Figure 2:
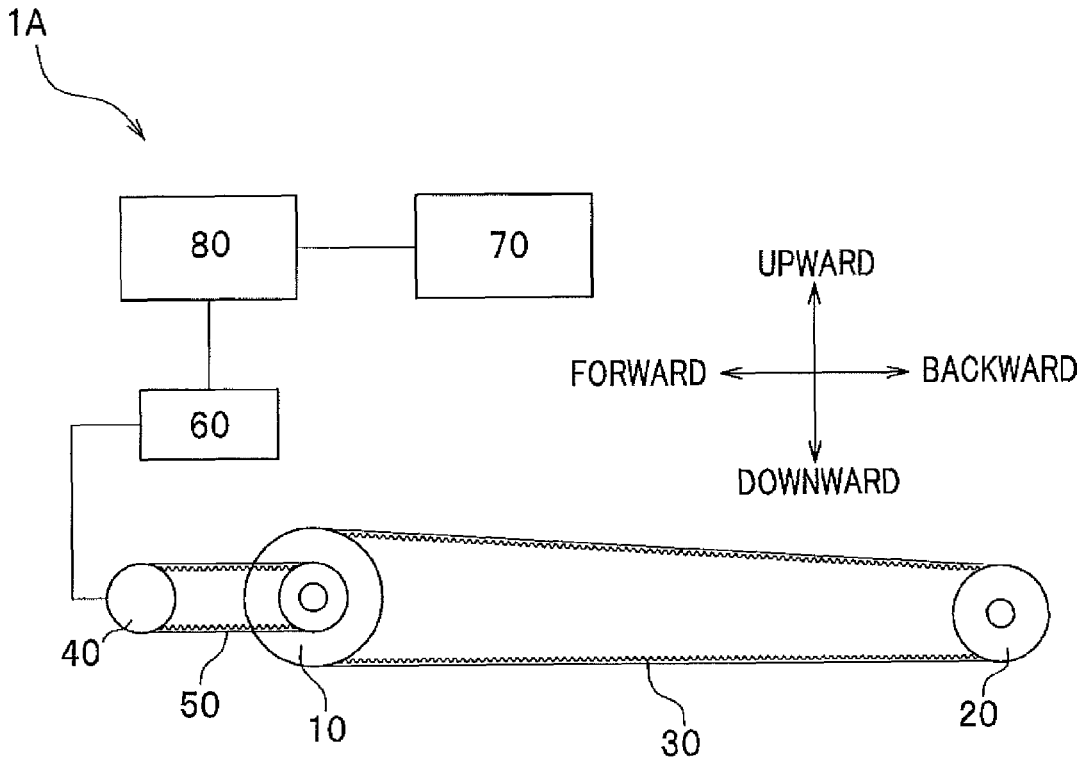
FIG. 2 is a schematic diagram of the tread mill according to the first embodiment of the present invention.
Figure 3A:
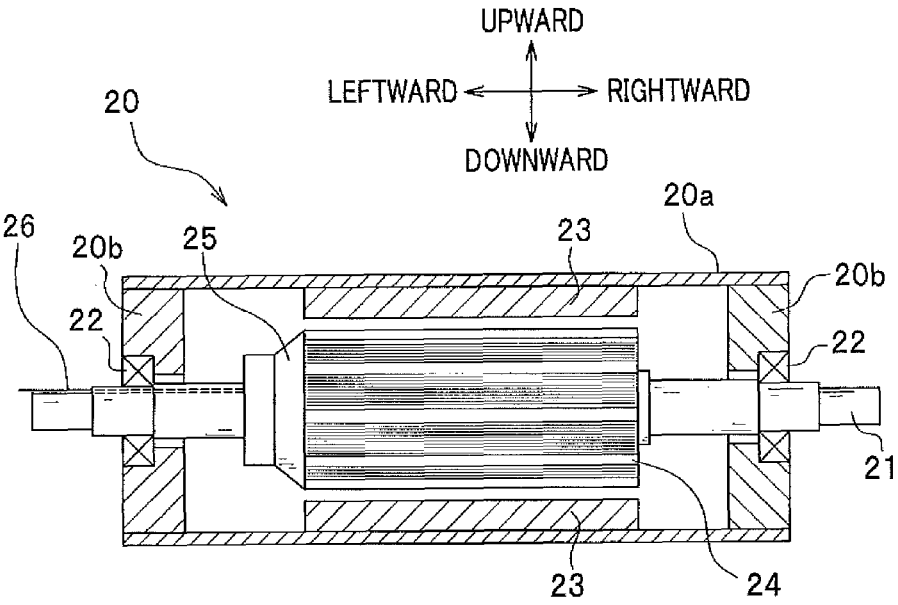
FIGS. 3A and 3B are cross-sectional views showing the inner structure of a roller according to the first embodiment of the present invention.
Figure 3B:
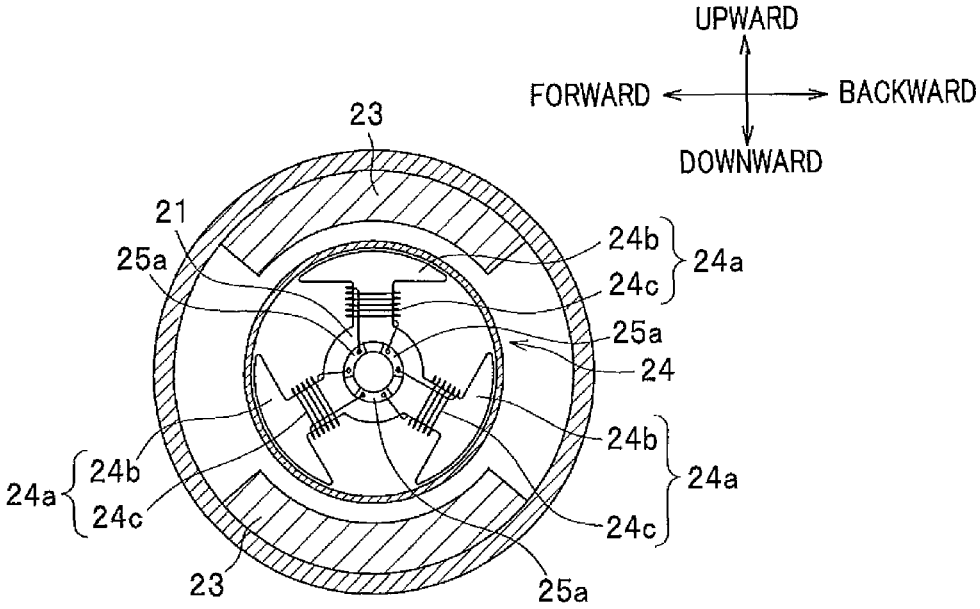

A tread mill according to a first embodiment of the present invention will be explained with reference to FIGS. 1 to 3. FIG. 1 is a general perspective view showing a tread mill according to a first embodiment of the present invention. FIG. 2 is a schematic diagram of the tread mill according to the first embodiment of the present invention. FIGS. 3A and 3B are a cross-sectional views showing the structure of a roller according to the first embodiment of the present invention, in which FIG. 3A is viewed from backward and FIG. 3B is viewed from leftward.

In the first embodiment of the present invention as shown in FIG. 1, a tread mill 1A is an exercise machine called "room runner" having an endless belt 30 on which a user 2 can run. As shown in FIG. 2, the tread mill 1A comprises: a pair of rollers 10 and 20; the endless belt 30, a pulley 40; an endless belt 50; a motor 60; an operation section 70; and a control section 80.

The rollers 10 and 20 are provided at a front end and a rear end of the tread mill 1A respectively. The user 2 can run on the endless belt 30 wound around the rollers 10 and 20. A pulley is attached to the front end roller 10, and the pulley 40 driven by the motor 60 is provided in front of the roller 10. The endless belt 50 is wound around the pulley attached to the roller 10 and the pulley 40. The operation section 70 is provided in front of the endless belt 30 so that the user 2 can operate buttons and a touch panel etc. provided thereon. Upon receiving operation put in by the user 2, the operation section 70 outputs signals corresponding to the input operations. The control section 80 includes: a central processing unit (CPU); a random access memory (RAM); a read only memory (ROM) etc. The control section 80 receives the signals put out by the operation section 70 and drives the motor 60 in accordance with the received signals.

The control section 80 drives the motor 60 in accordance with the signals sent from by the operation section 70. The motor 60 is driven with electric current supplied by a power source (commercial power source etc.) which is not shown in the drawings. The rotational force of the motor 60 is transmitted to the endless belt 30 via the pulley 40, the endless belt 50, and the roller 10 in this order. That is, in the tread mill 1A, the pulley is attached to the driving roller 10, and the roller 20 is a follower roller.

As shown in FIGS. 3A and 3B, the tread mill 1A according to the first embodiment of the present invention has a power-generating mechanism in the roller 20. The power-generating mechanism comprises: a shaft section 21; bearings 22; permanent magnets 23; an armature section 24; a commutator 25; and a pair of conductive wires 26. It should be noted that FIG. 3A shows one of the conductive wires 26.

The roller 20 has a hollow columnar cylinder section 20*a* extending in the rightward and leftward; and two end sections 20*b* disposed on the two horizontal ends of the cylinder section 20*a*. The cylinder section 20*a* and the two end sections 20*b* are made of light-weight material, e.g., iron, stainless-steel, or aluminum, which has rigidity endurable to the weight of the user 2 and the rotation of the endless belt 30.

The horizontally-extending elongated columnar shaft section 21 has two horizontal ends protruding from the two end sections 20*b* of the roller 20 and fixed in a housing of the tread mill 1A.

Each bearing 22 is provided in the vicinity of each horizontal end of shaft section 21. The housing of the tread mill 1A supports the roller 20 rotatably via the bearings 22 relative to the shaft section 21. The permanent magnets 23, attached to the inner periphery of the roller 20 and opposed to each other, rotate with the roller 20 integrally. The armature section 24 has a plurality of armatures 24*a* attached around the shaft section 21. Each armature 24*a* has an iron core 24*b* extending outwardly in a radial direction from the shaft section 21; and a coil 24*c* wound around the iron cores 24*b*.

The commutator 25 has a plurality of commutator plates 25*a* each connected to the coil 24*c* of the armature 24*a* electrically. The pair of conductive wires 26 is connected to the commutator plates 25*a* of the commutator 25 electrically. One of the ends of each conductive wire 26 extends to the exterior of the roller 20. For example, the conductive wires 26 may be disposed in grooves formed on the shaft section 21. The plurality of commutator plates 25*a* may be connected electrically with each other with conductive wires not shown in the drawings.

As previously explained, the roller 20 of the tread mill 1A has a power-generating mechanism which makes use of the principle of a DC motor. When the user 2 runs on the endless belt 30 while the control section 80 drives the motor 60, the roller 20 rotates around the shaft section 21. That is, when the permanent magnets 23 attached to the roller 20 rotate around the plurality of armatures 24*a* attached to the shaft section 21, electromagnetic induction occurs between the permanent magnets 23 and the armatures 24*a*, and then, an alternating electric current flows through the coils 24*c* of the armatures 24*a*. The alternating electric current is taken out of the roller 20 sequentially via the commutator plates 25*a* and the conductive wires 26 connected to the coils 24*c* electrically, and then supplied to the motor 60 of the tread mill 1A, the operation section 70, the control section 80, or other external apparatuses e.g. battery installed out of the tread mill 1A, which are connected to the conductive wires 26 electrically.

The tread mill 1A according to the first embodiment of the present invention can generate electric power while achieving a space-saving ability because the roller 20 has the power-generating mechanism therein. The bearings 22 support rotatable sections (roller 20 and permanent magnets 23) of the power-generating mechanism rotatably. Also, in the power-generating mechanism, the permanent magnets 23 rotate with the roller 20 integrally while the armature section 24 heavier than that of the permanent magnets 23 is fixed to the shaft section 21. Therefore, the present invention can minimize a friction loss and restrict the influence to the sliding movement of the endless belt 30 while generating electricity.

Second Embodiment

Figure 4:
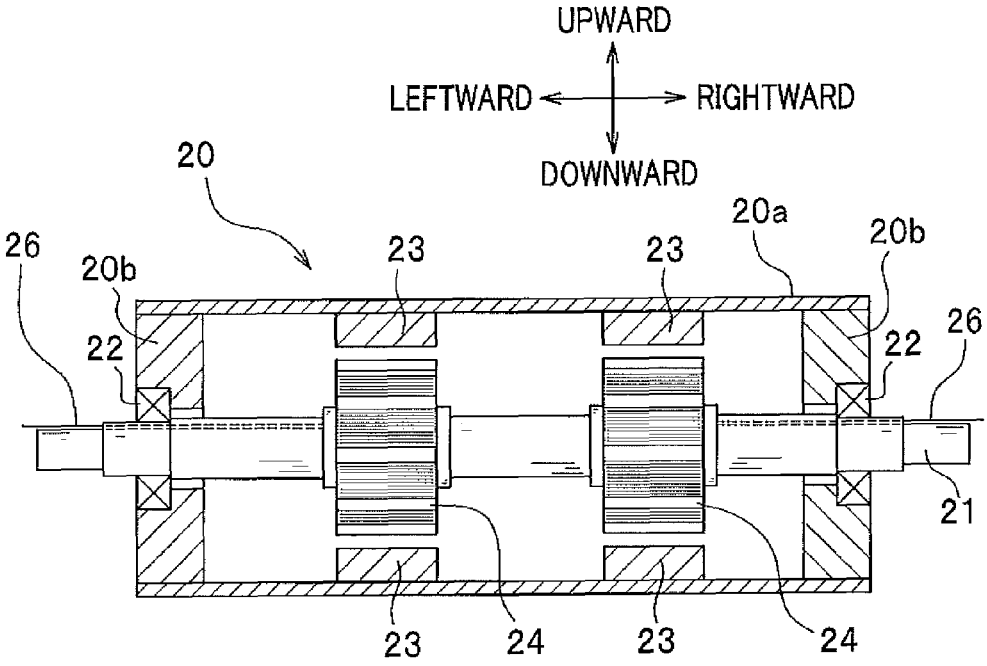
FIG. 4 is a cross-sectional view showing an inner structure of a roller according to a second embodiment of the present invention.

A tread mill according to a second embodiment of the present invention will be explained next with reference to FIG. 4 which shows the difference from the tread mill 1A of the first embodiment. FIG. 4 is a cross-sectional view showing the structure of a roller viewed from backward according to the second embodiment of the present invention.

As shown in FIG. 4, the tread mill according to the second embodiment of the present invention has two armature sections 24 in the roller 20. The roller 20 has four permanent magnets 23 therein since each armature section 24 has two permanent magnets 23. In each armature section 24, the plurality of coils 24*c* may be connected electrically with each other by using conductive wires not shown in the drawing.

If the coils 24*c* (see FIG. 3B) of the two armature sections 24 are connected electrically by using conductive wires, a direct electric current produced in the coils 24*c* of the two armature sections 24 is taken out of the roller 20 via the conductive wires connected electrically to the coils 24*c* of each armature section 24, and then supplied to the motor 60, the operation section 70; or the control section 80, and other external apparatuses e.g. battery installed out of the tread mill 1A, which are connected to the conductive wires electrically, of the tread mill 1A. Alternatively, as shown in FIG. 4, if the two armature sections 24 are separated electrically, the direct electric current produced in the coils 24*c* of the two armature sections 24 is taken out of the roller 20 via each conductive wire 26 connected electrically to the coils 24*c* of each armature section 24, and then supplied to the motor 60 of the tread mill 1A, the operation section 70, the control section 80; or other external apparatuses e.g. battery installed out of the tread mill 1A, which are connected to the conductive wires 26 electrically.

Third Embodiment

Figure 5:
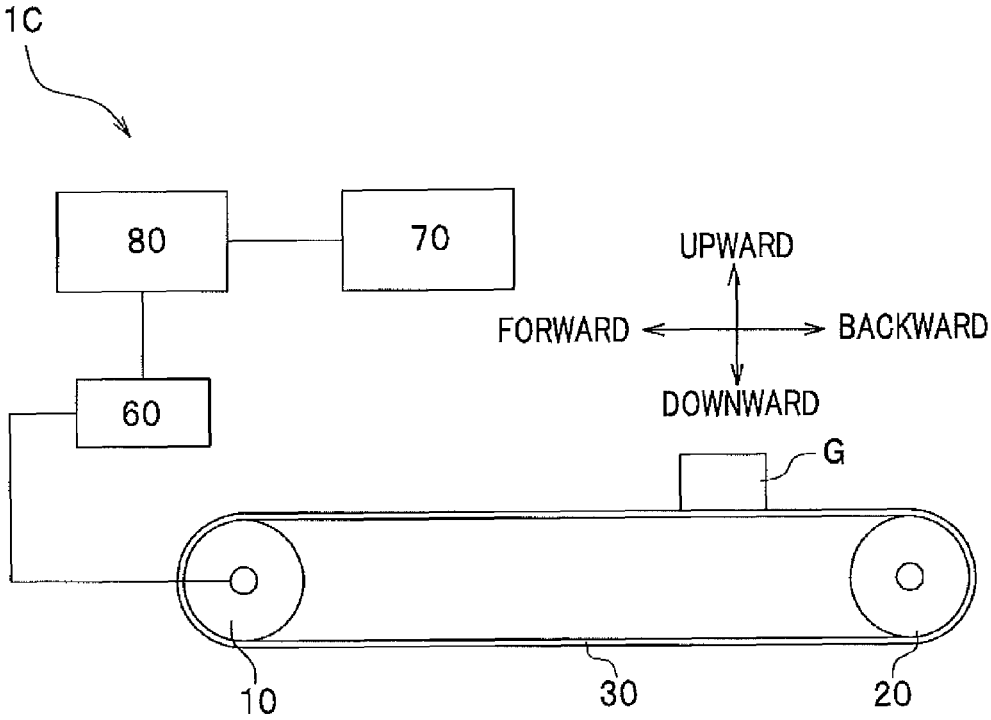
FIG. 5 is a schematic diagram of a conveyor according to a third embodiment of the present invention.

A tread mill according to a third embodiment of the present invention will be explained next with reference to FIG. 5 which shows the difference from the tread mill 1A of the first embodiment. FIG. 5 is a schematic diagram of a conveyor according to the third embodiment of the present invention.

According to the third embodiment of the present invention shown in FIG. 5, a conveyor 1C, which may be alternatively called a belt conveyor, conveys an article placed on a endless belt 30 when the endless belt 30 is rotated by the roller 10 driven directly by the motor 60. Similarly to the tread mill 1A according to the first embodiment, the conveyor 1C has a power-generating mechanism in the roller 20.

The present invention is not limited to the aforementioned embodiments and may be modified within the spirit and scope of the present invention. For example, the power-generating mechanism of the present invention may be provided in the driving roller 10 instead of the follower roller 20. Alternatively, if a conveyor adapts the conveyor structure of the present invention, the power-generating mechanism of the present invention may be provided in a tension roller integrally which adjusts the tension of the endless belt 30. If the bearings 22 are ball bearings, friction loss can be reduced by increasing the number of balls. If the distance between the inner periphery, making contact with the shaft section 21, of an inner ring of each bearing 22 and the center of each ball is greater, the greater number of balls can be disposed in the bearing. The power-generating mechanism provided in the roller 10 is not limited to the structure shown in the drawings. For example, the number of the armatures 24*a* and the number of the commutator plates 25*a* may be modified arbitrarily. The manner for connecting the conductive wires for taking the electric current out of the roller to the coils is not limited to the configuration shown in the drawings. A roller having the power-generating mechanism of the present invention may be applied to carriages etc.

What is claimed is:

1. A conveyor structure comprising:

at least two rollers; and an endless belt wound around the rollers;

a drive motor configured to drive and rotate one of the rollers;

at least a power-generating motor disposed inside a roll surface of one of the rollers, the roll surface contacting the endless belt, wherein the power-generating motor has an armature comprising an iron core, a coil wound around the iron core, a commutator comprising a plurality of commutator plates each connected to the coil electrically, permanent magnets fixed on an inner surface of the roller to face the armature and rotatable with the roller integrally, and a pair of conductive wires connected to the commutator plates electronically wherein one end of each of the pair of conductive wires extends to an exterior of the roller, and wherein the armature is fixed so as not to be rotatable together with the roller being rotated, and wherein the power-generating motor produces electric power by using electromagnetic induction produced between the permanent magnets and the armature when the roller is rotated, wherein the produced electric power is reused in the conveyor structure.

2. A tread mill having the conveyor structure as claimed in claim 1, wherein a person can run on the endless belt.

3. A conveyor having the conveyor structure as claimed in claim 1, wherein the conveyor can convey an article placed on the endless belt.

* * * * *